US007293662B2

(12) United States Patent
Klein et al.

(10) Patent No.: US 7,293,662 B2
(45) Date of Patent: Nov. 13, 2007

(54) HANGING SHOE RACK WITH IMPROVED STRUCTURAL FEATURES

(75) Inventors: Richard B. Klein, Overland Park, KS (US); John W. Scott, Lenexa, KS (US); Chris Serslev, Leawood, KS (US)

(73) Assignee: Lynk, Inc., Lenexa, KS (US)

( * ) Notice: Subject to any disclaimer, the term of this patent is extended or adjusted under 35 U.S.C. 154(b) by 413 days.

(21) Appl. No.: 10/934,170

(22) Filed: Sep. 3, 2004

(65) Prior Publication Data

US 2006/0049121 A1 Mar. 9, 2006

(51) Int. Cl.
*A47F 7/08* (2006.01)

(52) U.S. Cl. ..... 211/35; 211/118

(58) Field of Classification Search ..... 211/34–36, 211/119.004, 113, 118, 193, 194, 87.01, 90.01, 211/105.1, 105.2; D6/513, 514, 566, 567, D6/569, 570, 315, 317, 320, 553; 248/301, 248/364, 214, 300, 339

See application file for complete search history.

(56) References Cited

U.S. PATENT DOCUMENTS

D139,415 S 11/1944 Brown
D377,728 S 2/1997 Klein et al.
D381,225 S 7/1997 Malik
D382,434 S 8/1997 Klein et al.
5,695,073 A 12/1997 Klein et al.
5,855,279 A 1/1999 Klein et al.
6,138,841 A 10/2000 Klein et al.
7,097,048 B2 * 8/2006 Rimback et al. ..... 211/34

* cited by examiner

*Primary Examiner*—Brian E. Glessner
*Assistant Examiner*—Colleen M Quinn
(74) *Attorney, Agent, or Firm*—Blackwell Sanders LLP

(57) ABSTRACT

A hanging shoe rack for a closet door or other vertical surface. Frame sections have opposite sides provided with support arms that taper from top to bottom for reduced material requirements. The sections are connected by bars and feet having L-shaped tongues fitting in L-shaped slots with long curved surfaces in contact for enhanced strength. The bars that receive hanger brackets have strong curved connections with the frame sides. The tongues on the bars that hook to the brackets are reinforced by tabs that fit closely in notches in the brackets to resist side to side sway.

10 Claims, 4 Drawing Sheets

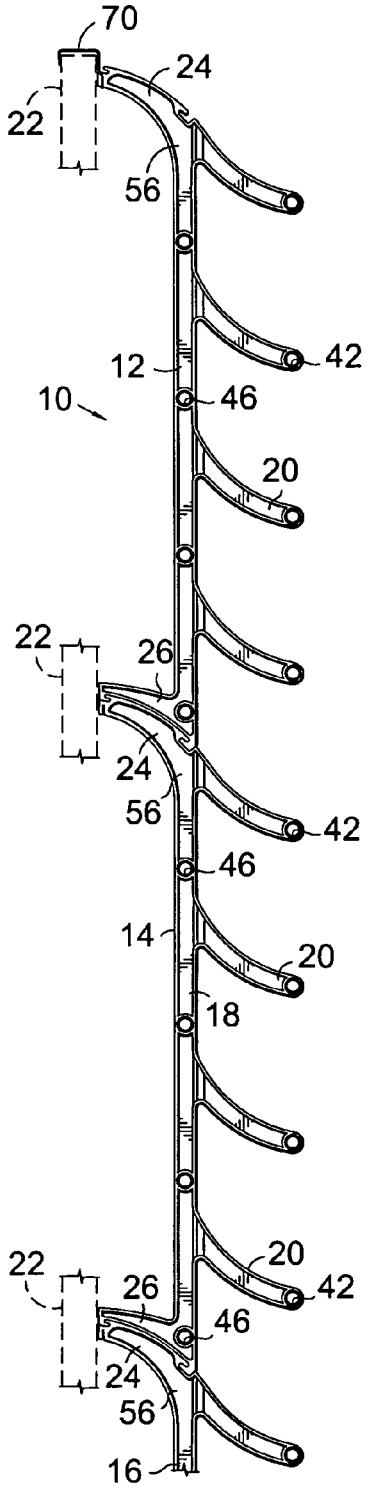
FIG. 7.
FIG. 8.
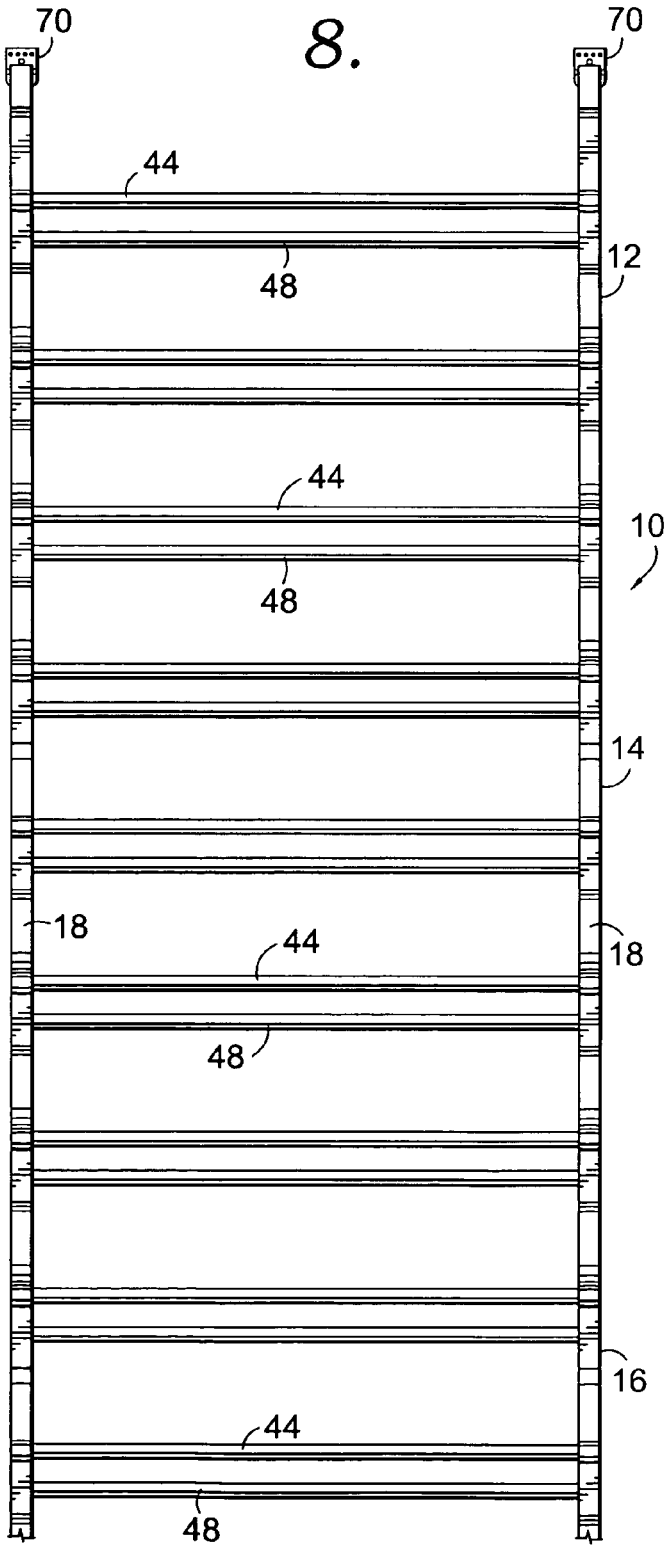

HANGING SHOE RACK WITH IMPROVED STRUCTURAL FEATURES

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates generally to hanging shoe racks and more particularly to shoe racks that can be hung on doors and other upright surfaces.

BACKGROUND OF THE INVENTION

Shoe racks that hang on closet doors have achieved considerable popularity, in large part because they allow shoes to be conveniently stored in a space that is otherwise not normally used. It is important from a cost standpoint to minimize the amount of material that is required to manufacture this type of shoe rack. At the same time, the shoe rack must be constructed with sufficient strength to withstand the forces that are applied to it in normal use, such as when the shoe rack is heavily loaded and the door is swung open or closed. Further, the appeal of the product is enhanced by maintaining an attractive appearance and particularly an appearance of substance and strength.

A shoe rack which is exemplified by U.S. Pat. No. 5,695,073 to Klein has been commercially successful primarily because it meets these criteria. However, improvements are still possible in some respects. For example, the shoe supporting arms require a relatively large amount of material in order to be strong enough to perform their function adequately. This adds to the cost in two ways—the material cost itself and the added molding cost resulting from the increased mold cycle cost due to the relatively thick parts that must be molded. The top bars to which the hanger brackets connect have a right angle connection with the frame sides. Consequently, gusset plates are required at these connections in order to structurally reinforce what otherwise would be a weak area subject to stress concentration and possible failure.

The connections between the different modular frame sections are made by T-shaped tongues fitting in T-shaped slots. The tongues and slots are relatively close together, and the pieces that connect them have only relatively small flat surface areas in contact with each other. As a result, these connections between the frame sections can create problems from a strength standpoint unless the parts are relatively large. However, this increases the amount of material that is required and the material costs are increased accordingly, as is the cost due to the increased mold cycle time that is required to make the part.

In the shoe rack disclosed in U.S. Pat. No. 5,695,073, the hanger brackets receive downwardly projecting tongues that are connected at one end with the bars from which they project. In order to prevent the tongues from possibly breaking, the ends that connect with the hanger bars must be thickened for enhanced strength. Again, this increases the material costs. It is also possible for the shoe rack frame to sway side to side on the brackets when the door is swung open or closed, and this can cause the shoes to become displaced and create other problems.

SUMMARY OF THE INVENTION

The present invention is directed to a shoe rack that is of the general type shown in U.S. Pat. No. 5,695,073 but is improved in a number of respects. As a result of these improvements, the quantity of material (typically molded plastic) can be reduced by up to one pound which creates important cost savings and advantages in shipping and handling of the product. Also, significant cost savings are achieved because the mold cycle time is reduced due to the thinner parts and the part design which better accommodates free flow of plastic throughout the mold cavity during the molding operation. An improved hanger bracket is also provided which requires less material and has improved structural features as well.

In accordance with one aspect of the invention, the arms that support the shoes are constructed with lower flanges that are significantly narrow than the upper flanges which are more visually prominent. By tapering the arm members in this manner, the material requirements are reduced. At the same time, the arm members appear to be large and strong because only the relatively large top flanges are readily noticeable.

According to another aspect of the invention, the hanger bars at the top ends of the frame sides have connections that are made in smooth and gradual curves rather than abruptly at right angles. As a result of this curved transition, adequate strength is provided without creating areas of stress concentration that require a gusset reinforcement. The elimination of gusset plates adds to the reduction in the material requirements and enhances the aesthetics of the product. The thinner hanger bars reduce the costs in that less material is required and the mold cycle time is reduced.

An additional feature of the invention is a stronger manner of connecting the modular frame sections together. The feet at the bottom of the sections are curved and extend for longer distances along the bars at the top of the underlying section. The relatively large surfaces that are in contact at these areas enhance the strength of the connections, as does the curved configuration which acts in the manner of an arch structure. L-shaped tongues and L-shaped slots that receive the tongues are at the extreme ends of the feet and the bars in order to maximize their spacing for added strength. The tongues and slots are also not located in common horizontal planes as occurs with prior art products.

A further aspect of the invention involves an improved connection between the hanger bars and the brackets that hang the shoe rack on the door. The ends of the bars have L-shaped tongues on which tabs are provided to strengthen the downwardly projecting legs of the tongues. Additionally, when the legs are received in slots on the hanger brackets, the tabs fit closely through notches in the brackets in order to strengthen and stabilize the connections and resist side to side sway of the shoe rack on the brackets.

Other and further objects of the invention, together with the features of novelty appurtenant thereto, will appear in the course of the following description.

BRIEF DESCRIPTION OF THE SEVERAL VIEWS OF THE DRAWINGS

In the accompanying drawings which form a part of the specification and are to be read in conjunction therewith and in which like reference numerals are used to indicate like parts in the various views:

FIG. 7 is a fragmentary side elevational view of the shoe rack shown in FIG. 1;

FIG. 8 is a front elevational view of the shoe rack shown in FIG. 1;

DETAILED DESCRIPTION OF THE PREFERRED EMBODIMENT

Figure 1:
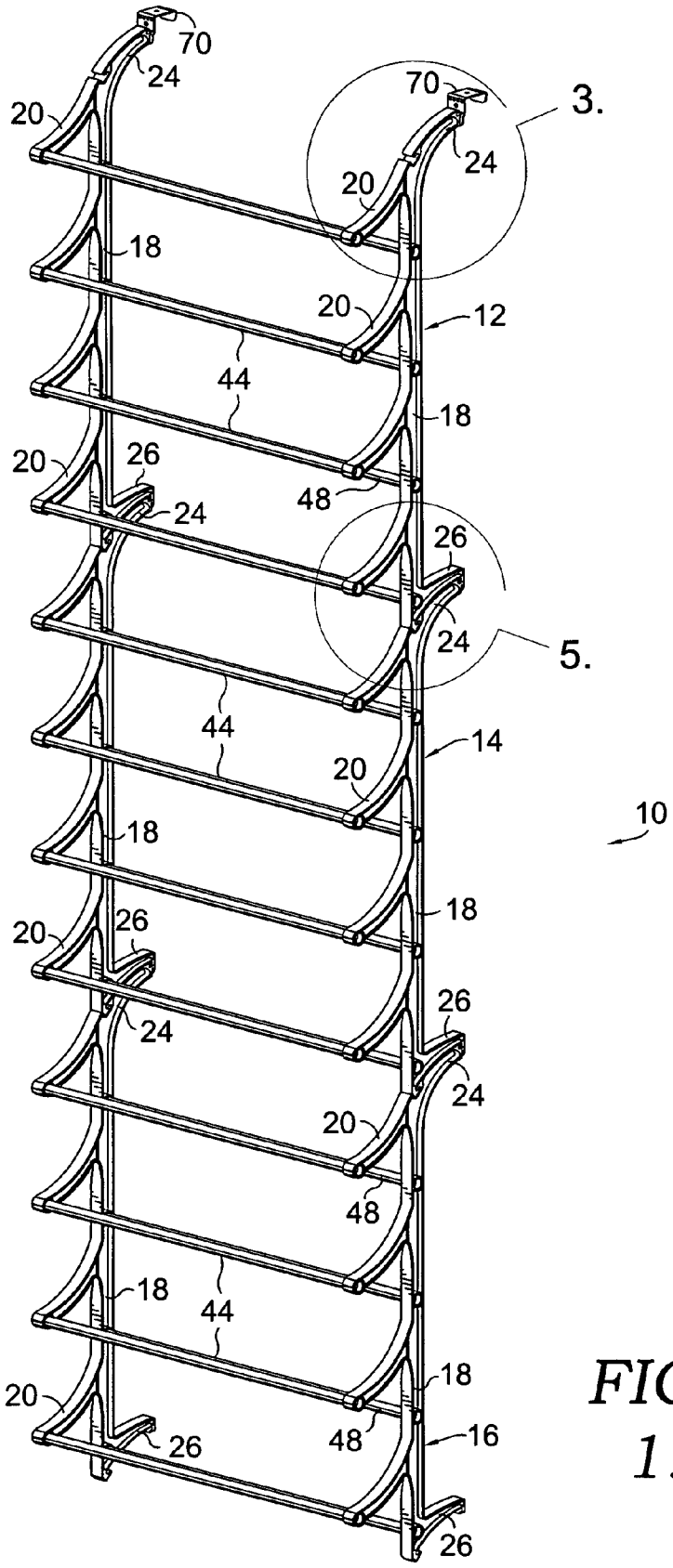
FIG. 1 is a perspective view of a hanging shoe rack constructed in accordance with a preferred embodiment of the present invention.
Figure 3:
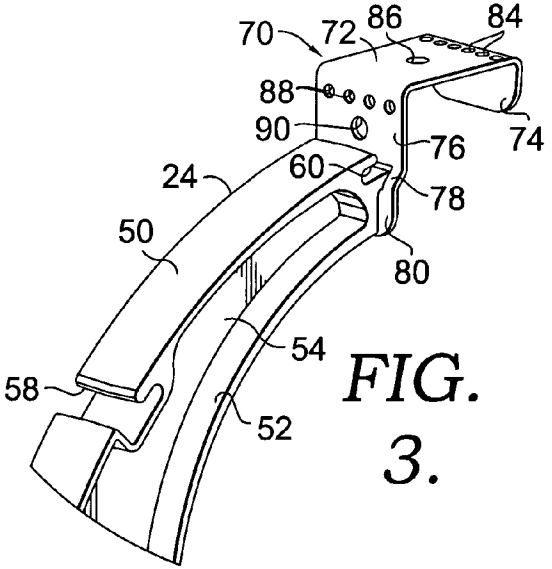
FIG. 3 is a fragmentary perspective view on an enlarged scale of a portion of the detail identified by numeral 3 in FIG. 1.

Referring now to the drawings in more detail and initially to FIG. 1 in particular, numeral 10 generally designates a hanging shoe rack constructed according to a preferred embodiment of the present invention. A shoe rack 10 include an upper section 12, an intermediate section 14 immediately below the upper section 12, and a bottom section 16 located immediately below the intermediate section 14. It should be understood that three sections are shown only by way of example and that the shoe rack can be constructed using a different number of sections.

Each of the sections 12, 14 and 16 may have the same construction and includes a frame having opposite parallel sides 18 that may be identical to one another. Each frame side 18 is provided with a plurality of spaced apart arms 20 which extend in a slightly curved configuration outwardly from the frame side or in a direction away from a vertical surface on which the shoe rack 10 is mounted (such as on a wall or other surface or the door shown fragmentarily in FIG. 7 and identified by numeral 22). At the top end of each frame side 18, a curved bar 24 extends rearwardly or toward the door 22 (or other vertical surface) and essentially forms a continuation of the top arm 20. The bottom end of each frame side 18 is provided with a foot 26 which extends toward the door 22 (or other surface) in a direction opposite the extension of the arms 20. As best shown in FIG. 7, the bars 24 and feet 26 cooperate to provide standoffs that space the frame sides 18 outwardly away from the surface of the door 22. The frame sides 18, arms 20, bars 24 and feet 26 may be formed integrally and may be constructed of molded plastic or any other suitable material.

Figure 5:
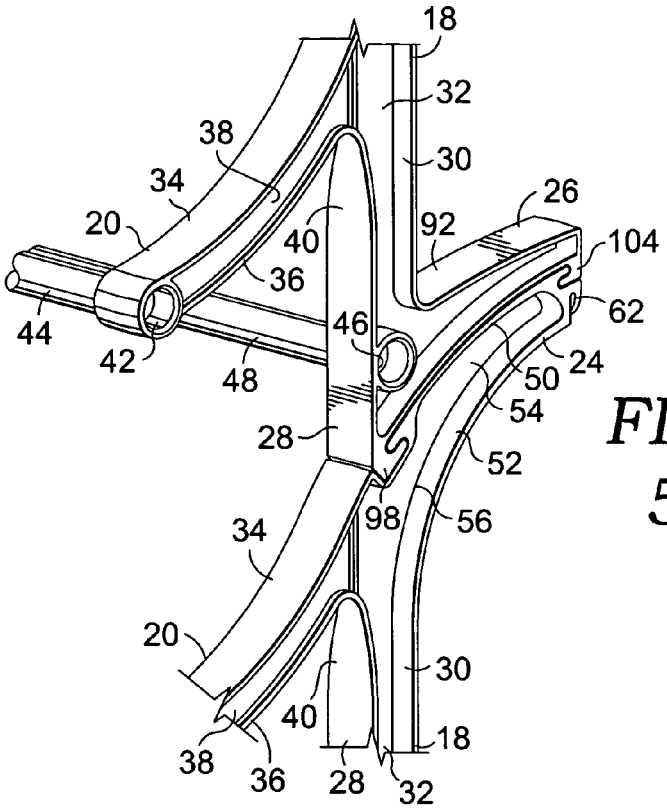
FIG. 5 is a fragmentary perspective view on an enlarged scale of the detail identified by numeral 5 in FIG. 1.
Figure 6:
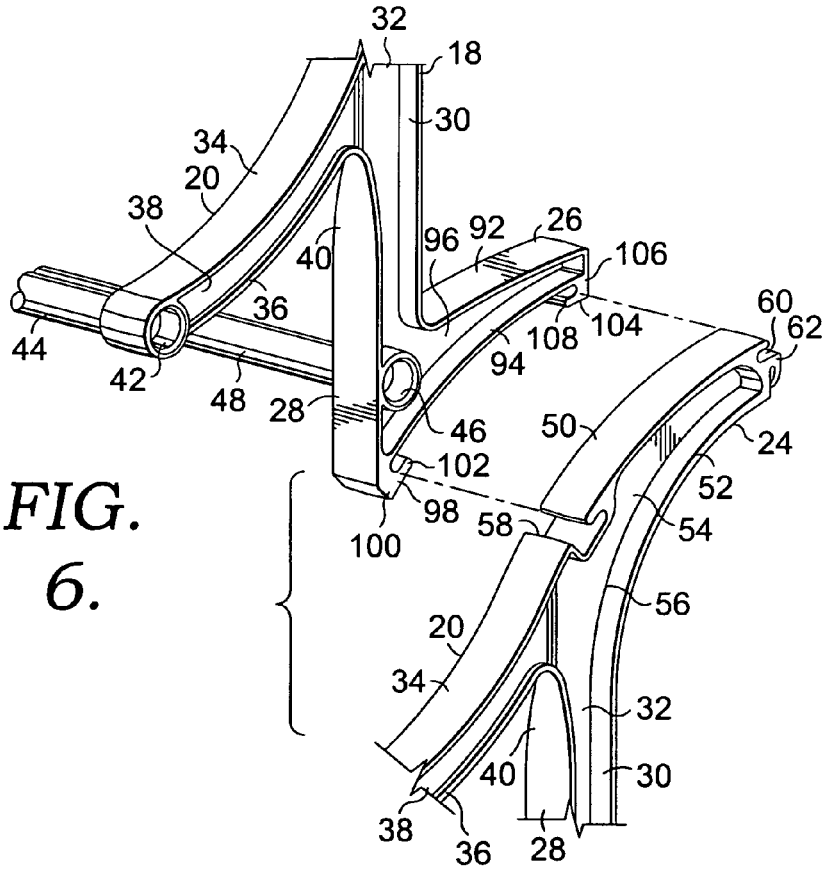
FIG. 6 is a fragmentary perspective view similar to FIG. 5, but showing adjacent sections of the shoe rack detached from one another.

The frame sides 18 are substantially straight members oriented vertically when the shoe rack 10 is hung or mounted on a support surface. As best shown in FIGS. 5 and 6, each side 18 is constructed in the manner of an I-beam having a front flange 28 from which the arms 20 extend, a rear flange 30 from which the bars 24 and feet 26 extend, and a rib or web 32 connecting the front and back flanges 28 and 30.

Figure 2:
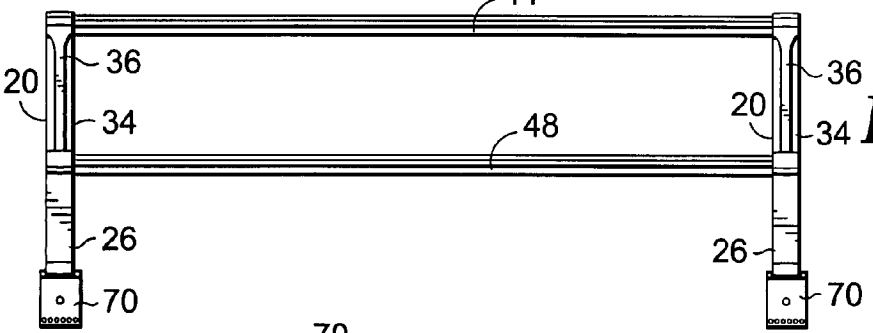
FIG. 2 is a bottom plan view on an enlarged scale of the shoe rack shown in FIG. 1.

As also shown in FIGS. 5 and 6, each of the arms 20 has an I-shaped construction. A top flange 34 is connected with a bottom flange 36 by a web 38. According to one aspect of the present invention, the top flange 34 may have a width dimension that is greater than the width dimension of the lower flange 36 (see FIG. 2 also). The lower flanges 36 of arms 20 may be formed integrally with the front flanges 28 of the frame sides 12. Flanges 28 taper as they approach each of the flanges 36, as indicated by numeral 40 in FIGS. 5 and 6. By way of example, the top flange 34 of each arm may be about 20 mm wide, whereas the bottom flange 36 may be approximately 8 mm wide. It is preferred that the top flange be at least twice as wide as the bottom flange. The flanges 28 thus may taper from a normal width of about 20 mm to a width of approximately 8 mm at the tapered portion 40 such that the bottom flange 36 of each arm 20 can have a constant width of approximately 8 mm.

The outer end of each arm 20 is provided with a cylindrical socket 42. Horizontal rods 44 extend between the arms 20 on the opposite frame sides of each section 12, 14 and 16, with the ends of the rods being received in the sockets 42. Additional pairs of sockets 46 are provided at locations spaced along the frame sides 18. Additional shoe supporting rods 48 are received at their opposite ends in the sockets 46 on the opposite frame sides. The rods 44 and 48 are arranged in pairs, with the rod 48 in each pair being located somewhat below the level of the corresponding outer rod 44 so that shoes may be received and held on the pairs of rods 44 and 48 with the shoes angling downwardly toward the door 22 or other surface on which the shoe rack is mounted.

Each of the bars 24 has an I-shaped construction, with an upper flange 50 connected with a lower flange 52 by a web 54. The bars 24 have gradually curved connections 56 with the frame sides 18 such that a curved transition is provided between each bar 24 and the frame side 18. The flanges 30 gradually merge with flanges 52 in a curved transition, and webs 32 merge with webs 54 in curved transitions. These curved connections or transitions 56 between the sides 18 and bars 24 provide adequate strength without requiring structural reinforcement by way of gusset plates or other structures that add to the material requirements of the shoe rack. Additionally, the strength of the curved members allows for thinner parts which reduces the material cost and the mold cycle time.

The upper surface of each of the bars 24 is a gradually curved surface provided on the top surface of the upper flange 50. On the end of each arm 24 that connects with the frame side 18, an L-shaped slot 58 (FIG. 6) is formed in the top surface of the arm 24 at a location in line with the frame side 18. The opposite or free end of each arm 24 is provided with a similar L-shaped slot 60 which is located on the extreme free tip of the arm 24. Each pair of slots 58 and 60 have undercut toes at the bases of the slots that extend toward one another.

With reference to FIGS. 3-4 and 9-10 in particular, immediately below each of the slots 60, the tip of each arm 24 is provided with an L-shaped tongue 62 having a base portion 64 projecting from the tip of the arm and a down turned leg 66 on the end of the base portion 64. A tab 68 (FIG. 9) extends from the tip of the arm 24 to connection with the leg 66 in order to provide structural reinforcement to the tongue 62 and particularly the leg 66. The top end of the tab 68 connects with the base 64 and may be integral with the base 64 and leg 66. Tab 68 may occupy a vertical plane and may be rounded on its lower edge.

The shoe rack 10 is mounted on door 22 (or another upright surface) through the use of a pair of hanger brackets 70 which may be identical to one another. As best shown in FIGS. 3-4 and 9-10, each bracket 70 has a U-shaped body that includes a flat plate 72 at the top for spanning the width of the door 22. A down turned lip 74 is formed on one end of the plate 72 to be hooked on one surface of the upper edge of the door 22. On the opposite end of plate 72, a flat leg 76 extends downwardly to lie against the opposite surface of the door 22. A bent shoulder 78 is bent away from the lower portion of leg 76 and connects with a vertical flange 80. A generally rectangular slot 81 extends through the shoulder 78 and has a size and shape to closely receive the down turned leg 66 of tongue 62. A vertical notch 82 (FIG. 4) is formed in the flange 80 and extends downwardly from the slot 81. Notch 82 has a size and shape to closely receive the tab 68.

The plate 72 of each bracket 70 may be provided with a line of perforations 84 which allow the lip 74 to be broken away from the bracket 70. An opening 86 may be formed in the center portion of plate 72 in order to receive a fastener such as a nail or screw (not shown) that may be used for fastening of the bracket 70 to a door or other structure in a case where the lip 74 is detached. The upper portion of leg 76 may also be provided with a line of perforations 88 that allow the plate 72 and lip 74 to be broken away from the bracket 70. An opening 90 formed in the plate 76 may receive a fastener such as a nail or screw (not shown) which may be used to fasten the bracket 70 to a vertical surface such as a wall in a case where the plate 72 and lip 74 are detached from the bracket.

With reference to FIGS. 5 and 6 in particular, each of the feet 26 may have an I-shaped construction. An upper flange 92 and a lower flange 94 are connected by a vertical web 96. The feet 26 on the lower ends of each of the sections 12 and 14 may be connected with the bars 24 of the immediately underlying section in order to connect the different sections of the shoe rack together. With continued reference to FIGS. 5 and 6 in particular, one end of each foot 26 is provided with an L-shaped tongue 98 which is located in line with the frame side 18. Each tongue 98 has a downwardly projecting leg 100 and a base or toe 102 projecting from the lower end of the leg 100. The opposite end of each foot 26 has a free end which is provided on its tip with a projecting tongue 104 having a leg 106 and a base or toe 108 projecting from the lower end of the leg 106. The toes 102 and 108 extend generally toward one another on each of the feet 26. The tongues 98 and 104 have a size and shape to fit closely in the slots 58 and 60 in a manner to connect the adjacent sections of the shoe rack together, as best shown in FIG. 5.

In use, the shoe rack 10 is assembled by connecting the sections 12, 14 and 16 together. This is accomplished in a manner best shown in FIG. 5 by connecting the bars 24 and feet 26 together which involves inserting the tongues 98 and 104 into the L-shaped slots 58 and 60 to interlock tongues 98 in slots 58 at one end of the bars and feet and to interlock tongues 104 in slots 60 at the other end of the bars and feet. Because the tongues 98 and 104 are located at the extreme ends of the feet 26, and the slots 58 and 60 are similarly located at the extreme ends of the bars 24, the two points of connection between each pair of feet and bars are relatively far apart and the strength of these connections is enhanced as a result. Additionally, the considerable lengths of the curved surfaces provided by the flanges 50 and 94 that lie against one another along the entire length between the tongues and slots enhances the strength of the connections, as does the curved shapes of the mating surfaces which provide an arch effect. It is also noted that the tongues and slots of each mating pair of feet and bars are in different horizontal planes for still additional strength.

Figure 10:
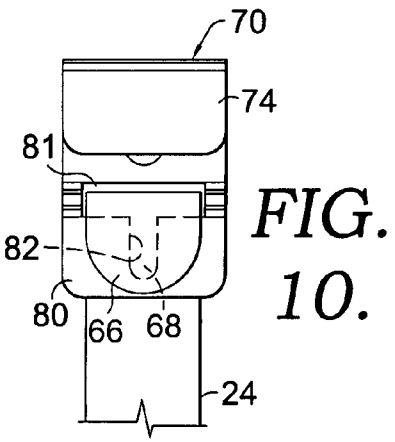
FIG. 10 is a fragmentary rear elevational view of an enlarged scale showing a hanger bracket applied to a hanger bar of the shoe rack.
Figure 9:
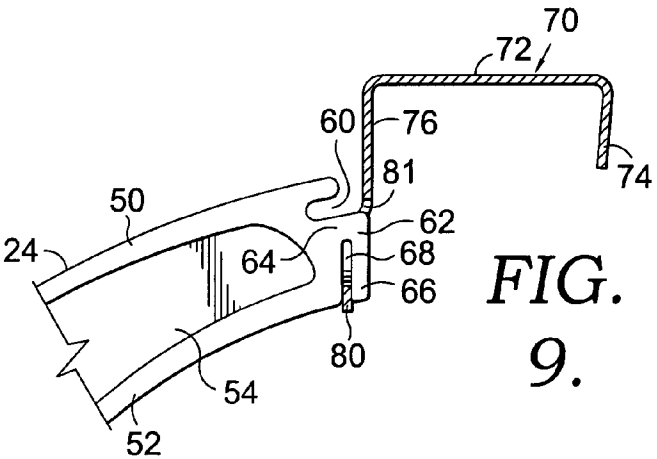
FIG. 9 is a fragmentary sectional view on an enlarged scale taken through a hanger bar and hanger bracket of the shoe rack.
Figure 4:
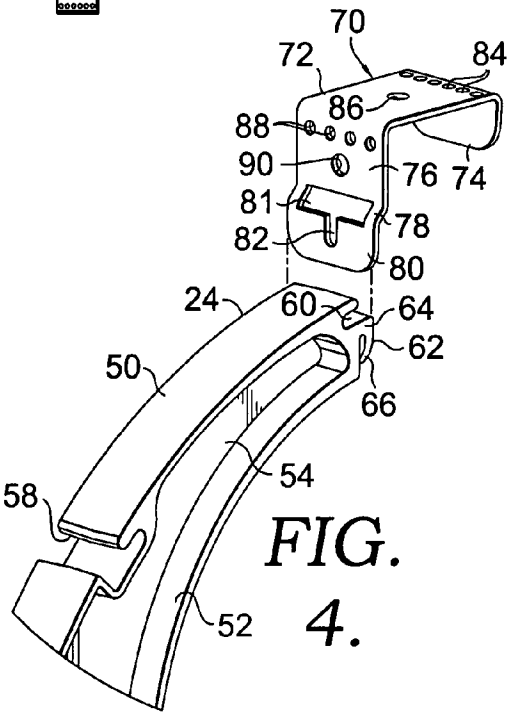
FIG. 4 is a fragmentary perspective view similar to FIG. 3 but showing the hanger bracket detached from the bar to which it connects in use.

As best shown in FIGS. 9-10, the brackets 70 are connected to the bars 24 of the upper section 12 by inserting the tongues 62 in the slots 81. In particular, the legs 62 are closely received in slots 81, with the tabs 68 simultaneously fitting closely in the notches 82. The brackets 70 may then be applied over the upper edge of the door 22 as shown in FIG. 7 (or fasteners such as nails or screws may be applied through the openings 86 of 90 if desired). This mounts the rack 10 in a stable manner on the door 22, a wall or another vertical surface on which the shoe rack may be mounted. The tabs 68 provide structural reinforcement for the tongues 62 and additionally fit closely in the notches 82 in order to strengthen and stabilize the connections between the bars 24 and brackets 70 and particularly to resist undue side to side sway of the shoe rack on the brackets.

When the shoe rack 10 is mounted on door 22 or another vertical surface (FIG. 7), the connected bars 24 and feet 26 cooperate to provide effective standoffs that space the sides 18 away from the surface of the door 22 (the foot 26 on the bottom section 16 serves as a standoff by itself). The curved transitions between the bars 24 and the frame sides 18 provide strength at areas that could otherwise be subject to stress concentrations requiring gusset plates or other reinforcing techniques that can add to the complexity and cost of the shoe rack and create an unattractive appearance. This also allows for thinner parts requiring less material and a shorter cycle time. The tapering of the arms 20 from top to bottom (see FIG. 2) reduces the amount of material and the mold cycle time while also providing an appearance of strength because only the relatively wide top flange 34 of each arm 20 is prominent.

Whether hung or otherwise mounted on a door or other surface, the shoe rack 10 conveniently holds shoes individually or in boxes, as well as other objects.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

The invention claimed is:

1. A hanging shoe rack comprising:

an upper section adapted to be mounted on an upright surface and having a lower end portion presenting a projecting foot having a curved lower surface shaped with a gradual curvature along substantially the entire length of said foot;

a lower section for connection to said upper section and having an upper end portion presenting a projecting bar having a curved upper surface shaped with a gradual curvature along substantially the entire length of said bar and arranged to mate with and extend along said curved lower surface of said foot with said bar and foot providing a standoff for engagement with said upright surface;

a connection between said upper and lower sections connecting said foot and said bar with said curved surfaces thereof mating with and extending along each other to provide an arch effect;

a plurality of spaced apart support arms on each of said sections; and a plurality of shoe support rods extending between said arms for receiving and storing shoes.

2. A shoe rack as set forth in claim 1, wherein:

said foot has a first end connected with said upper section and a second end opposite said first end;

said bar has a first end connected with said lower section and a second end opposite said first end of said bar; and said connection includes a first interlock between said first ends of said foot and bar and a second interlock between said second ends of said foot and bar.

3. A shoe rack as set forth in claim 2, wherein each of said interlocks comprises a generally L-shaped slot in one of said curved surfaces and a generally L-shaped tongue on the other of said curved surfaces fitting closely in said slot.

4. A shoe rack as set forth in claim 3, wherein one of said L-shaped slots is on said second end of said bar.

5. A shoe rack as set forth in claim 1, wherein said upper and lower sections have the same configuration.

6. A shoe rack as set forth in claim 1, wherein:

said upper section includes a pair of opposite frame sides each having an upper end; and said upper end of each frame side is provided with a bar having a curved connection with the frame side and adapted to provide a hanging connection on said upright surface.

7. A shoe rack as set forth in claim 1, wherein each of said arms comprises upper and lower flanges each having a width dimension and connected by a web member, said upper flange having a width dimension greater than the width dimension of said lower flange.

8. A hanging shoe rack comprising:

an upper section adapted to be mounted on an upright surface and including a pair of frame sides each having a lower end;

first and second feet projecting from said lower ends of the respective frame sides, each foot having a curved lower surface and first and second ends with said first ends being in line with said frame side and said second ends being opposite said first ends, said curved lower surfaces being shaped with a gradual curvature along substantially the entire lengths of said first and second feet;

a lower section including a pair of frame sides each having an upper end;

first and second bars projecting from the respective frame sides of said lower section, each bar having a curved upper surface and first and second ends with said first ends of the bars being in line with said frame sides of the lower section and said second ends of the bars being opposite said first ends of the bars, said curved upper surfaces being shaped with a gradual curvature along substantially the entire lengths of said first and second bars;

a first slot in said first end of each bar;

a second slot in said second end of each bar;

a first tongue in said first end of each foot;

a second tongue on said second end of each foot, said first tongues fitting closely in the respective first slots and said second tongues fitting closely in the respective second slots to connect said lower section to said upper section with the curved lower surfaces of said feet mating with and extending along the curved upper surfaces of the respective bars to provide an arch effect with said second ends of the feet and bars being positioned for engagement with said vertical surface to space said frame sides of the upper and lower sections away from said vertical surface; and shoe supporting members on said upper and lower sections constructed and arranged to receive and hold shoes thereon.

9. A shoe rack as set forth in claim 8, wherein:

said first and second slots each has a generally L-shaped configuration; and said first and second tongues each has a generally L-shaped configuration.

10. A shoe rack as set forth in claim 9, wherein said first and second tongues each has a leg and a toe, said toes of the respective first and second tongues extending generally toward each other.

* * * * *